US007650922B2

(12) United States Patent
Alberti

(10) Patent No.: US 7,650,922 B2
(45) Date of Patent: Jan. 26, 2010

(54) WINDOW TREATMENT FOR ARCH-SHAPED WINDOW

(76) Inventor: Domenic Alberti, 13 Bruce La. South, Kings Park, NY (US) 11754

( * ) Notice: Subject to any disclaimer, the term of this patent is extended or adjusted under 35 U.S.C. 154(b) by 202 days.

(21) Appl. No.: 11/522,047

(22) Filed: Sep. 14, 2006

(65) Prior Publication Data

US 2008/0093031 A1 Apr. 24, 2008

(51) Int. Cl.
*A47H 5/00* (2006.01)

(52) U.S. Cl. ..... 160/84.07; 160/134; 160/168.1 V; 160/172 V; 160/900

(58) Field of Classification Search ..... 160/84.07, 160/134, 168.1 V, 172 V, 900
See application file for complete search history.

(56) References Cited

U.S. PATENT DOCUMENTS

| | | | | | |
|---|---|---|---|---|---|
| 1,609,877 | A | * | 12/1926 | Kendall | 160/84.07 |
| 4,776,380 | A | * | 10/1988 | Lester | 160/134 |
| 4,934,434 | A | | 6/1990 | Schnebly et al. | |
| 4,993,469 | A | * | 2/1991 | Moench | 160/168.1 P |
| 5,002,112 | A | | 3/1991 | Schnebly et al. | |
| 5,010,939 | A | * | 4/1991 | King | 160/84.07 |
| 5,044,418 | A | * | 9/1991 | Donahue | 160/330 |
| 5,109,910 | A | * | 5/1992 | Tortorella et al. | 160/197 |
| 5,168,912 | A | * | 12/1992 | Jelic et al. | 160/84.07 |
| 5,183,092 | A | * | 2/1993 | Jelic | 160/84.07 |
| 5,537,780 | A | * | 7/1996 | Cleaver et al. | 49/82.1 |
| 5,597,026 | A | * | 1/1997 | Fuentes et al. | 160/115 |
| 5,662,153 | A | | 9/1997 | Rosenblatt | |
| 5,765,619 | A | | 6/1998 | Arnold | |
| 5,794,680 | A | * | 8/1998 | Xue | 160/84.07 |
| 5,918,417 | A | | 7/1999 | Kinder | |
| 6,029,733 | A | * | 2/2000 | Xue | 160/84.07 |
| 6,145,569 | A | * | 11/2000 | Shaw et al. | 160/84.07 |
| 6,341,447 | B1 | | 1/2002 | Jean | |
| 6,390,172 | B1 | * | 5/2002 | Fleishman et al. | 160/168.1 V |
| 6,585,027 | B1 | * | 7/2003 | Roberts | 160/349.1 |
| 6,651,722 | B1 | * | 11/2003 | Fleishman et al. | 160/168.1 V |
| 6,758,256 | B1 | * | 7/2004 | Garcia | 160/134 |
| 6,830,091 | B2 | * | 12/2004 | Hintennach et al. | 160/172 V |
| 6,877,546 | B1 | * | 4/2005 | Garcia | 160/134 |
| 7,048,027 | B1 | * | 5/2006 | Abita | 160/84.07 |
| 7,188,658 | B1 | * | 3/2007 | Nordstrom et al. | 160/84.07 |
| 7,249,623 | B2 | * | 7/2007 | Chhun et al. | 160/84.07 |
| 7,490,653 | B2 | * | 2/2009 | Ying | 160/84.07 |
| 2007/0284056 | A1 | * | 12/2007 | Ying | 160/84.07 |
| 2008/0093031 | A1 | * | 4/2008 | Alberti | 160/84.07 |
| 2008/0093032 | A1 | * | 4/2008 | Foley et al. | 160/84.07 |
| 2008/0135188 | A1 | * | 6/2008 | DeBauche | 160/84.06 |

* cited by examiner

*Primary Examiner*—Katherine W Mitchell
*Assistant Examiner*—Philip S Kwon
(74) *Attorney, Agent, or Firm*—James M. Loeffler, Esq.

(57) ABSTRACT

A window treatment for an arch-shaped window including a frame having an arch portion and a horizontal portion; at least one shade panel pivotally connected to a central portion of the horizontal portion of the frame; at least one channel formed on an inner surface of the arch portion, wherein the at least one channel forms a longitudinal slot on an inner surface thereof; and a chain at least partially housed within the at least one channel and moveable therein for effectuating arcuate movement of the at least one shade panel between an open and a closed position, wherein the chain is configured and dimensioned to move within the at least one channel without falling out of the longitudinal slot.

19 Claims, 7 Drawing Sheets

WINDOW TREATMENT FOR ARCH-SHAPED WINDOW

BACKGROUND OF THE INVENTION

1. Field of the Invention

This invention relates generally to the field of blinds for use in windows and more particularly to collapsible blinds for use in arch-shaped windows.

2. Description of the Prior Art

Many buildings have windows that are arch shaped. Often it is desirable to prevent sunlight from directly entering the building through these arch windows. For these reasons, a number of blinds suitable for arch windows have been developed. Some designs such as are shown in U.S. Pat. No. 4,776,380 to Lester use venetian blinds. Venetian blinds have many slats making them relatively difficult to assemble, opaque and of distinctive appearance.

Simpler designs employ pleated material rather than venetian blind slats. Some pleated material designs use curved round rods such as shown in U.S. Pat. No. 1,609,877 to Kendall. Other designs require that supports be affixed into the window structure. These supports can be a plurality of hooks as shown in U.S. Pat. No. 4,825,611 to Basset or a mounting block as shown in U.S. Pat. No. 4,934,436 to Schnebly.

Accordingly, there are a large variety of blinds or shades for windows in the marketplace, including both vertical and horizontal types. Their most common characteristic is that they are foldable and that they have a rectangular shape, when they are in an unfolded position.

Since also most conventional windows are rectangular in shape, no problem is encountered for this class of windows. There is, however, a better class of windows of higher finesse and elegance, which have at least one arched portion. This class of windows is generally referred to as arched windows. It becomes evident then, that the conventional blinds, having a rectangular shape, may not be used in conjunction with arched windows.

Although it might sound as a simple problem to solve, it certainly is not. Mere proof of this is the fact that the applicant has not been able to find such a blind available in the marketplace.

A number of attempts have been made, but apparently they have all failed to provide an effective solution, since none of these approaches has been accepted by the public, as the absence of commercially available blinds for arched windows evidences.

Representative references describing blinds for arched windows may be found in the patent literature as early as 1891, but after the first quarter of the 20th century, no substantial progress seems to have been made.

U.S. Pat. No. 451,068 to Lark, issued Apr. 28, 1891; U.S. Pat. No. 602,967 to Wells, issued Apr. 26, 1893; and U.S. Pat. No. 1,609,877 to Kendall, issued Dec. 7, 1926, disclose blinds for arched windows, which, however, are driven by cumbersome cord mechanisms acting o the outside circumference of the blind, and having serious disadvantages, such as for example the need for hiding these mechanisms within an extended portion of the blind, thus sacrificing useful window area, as well as decorative window aspects. Other serious disadvantages include, but are not limited to, the fact that the complicated cord mechanisms are liable to malfunction, to the fact that no effective way of maintaining the opening of the blind at any desired level is provided, and to the fact that blinds structured to be driven by cord mechanisms at their circumference are not easily controllable, and therefore flimsy in their operation.

There is a need for a simplified blind for arch windows that uses pleated blind material and does not have many visible support rods, support hooks, cords or other readily noticeable support structure. Preferably, the blind should have no support rods or support hooks. The blind should be low cost, reliable, easy to assemble and easy to operate. Preferably, the blind should be capable of remote operation such as through use of a pull cord.

SUMMARY OF THE INVENTION

It is an object of the present invention to provide an arch shaped window treatment to solve the problems which currently exist in the prior art. More specifically, it is an object of the present invention to provide a window treatment for an arch-shaped window including a frame having an arch portion and a horizontal portion; at least one shade panel pivotally connected to a central portion of the horizontal portion of the frame; at least one channel formed on an inner surface of the arch portion, wherein the at least one channel forms a longitudinal slot on an inner surface thereof; and a chain at least partially housed within the at least one channel and moveable therein for effectuating arcuate movement of the at least one shade panel between an open and a closed position, wherein the chain is configured and dimensioned to move within the at least one channel without falling out of the longitudinal slot. The at least one shade panel may include a first and a second shade panel formed in a pleated or honeycomb configuration. The window treatment further includes a U-shaped removably secured to a central portion of the horizontal portion. A valence may be mounted on the arch portion and the horizontal portion to prevent the intrusion of sunlight around the perimeter of the window treatment.

The invention is not limited to the above-described embodiments, and various changes are possible without departing from the principles set forth herein. Furthermore, the embodiments include the invention at various stages, and various inventions can be extracted by properly combining multiple disclosed constructional requirements. There are many applications of this design.

The above is a brief description of some deficiencies in the prior art and advantages of the present invention. Other features, advantages and embodiments of the invention will be apparent to those skilled in the art from the following description, drawings.

BRIEF DESCRIPTION OF THE DRAWINGS

The invention will become more clearly understood from the following detailed description in connection with the accompanying drawings, in which.

DETAILED DESCRIPTION OF THE PREFERRED EMBODIMENTS

The following description is presented to enable one of ordinary skill in the art to make and use the invention and is provided in the context of a patent application and its requirements. Various modifications to the preferred embodiments will be readily apparent to those skilled in the art and the generic principles herein may be applied to other embodiments. Thus, the present invention is not intended to be limited to the embodiment shown but is to be accorded the widest scope consistent with the principles and features described herein.

Figure 1:
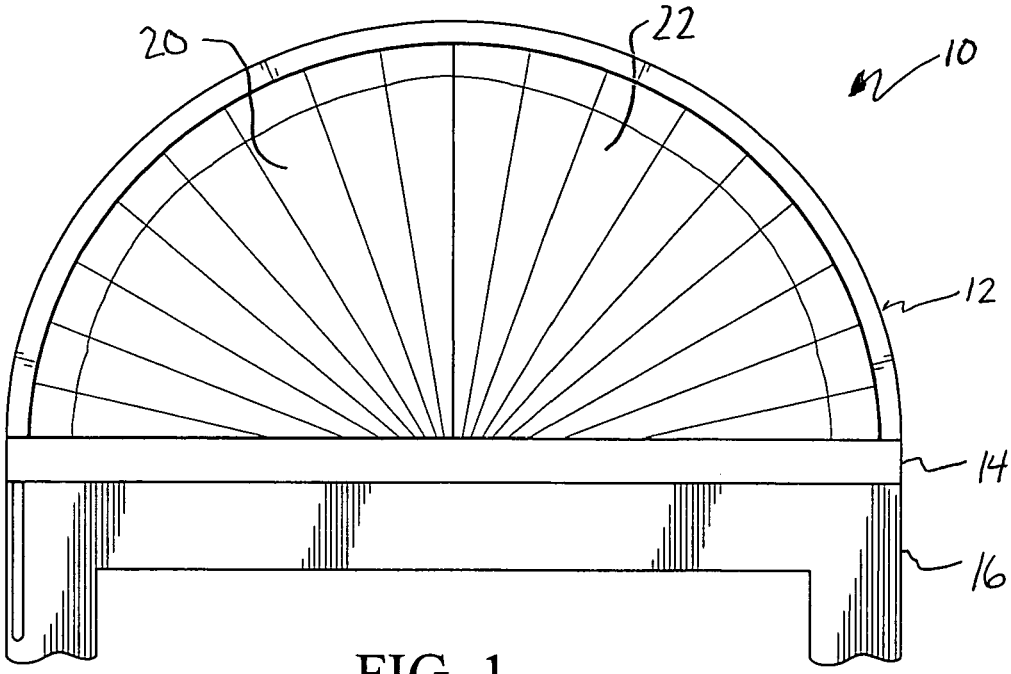
FIG. 1 is a front view illustrating a window treatment for an arch-shaped window in a closed position, in accordance with an embodiment of the present invention.

Referring now to the drawings in detail, and first to FIG. 1, a window treatment for an arch-shaped window in a closed position is illustrated, in accordance with an embodiment of the present invention. The window treatment 10 comprises a frame built up of wood and including an outer frame arch or bow 12 and a horizontal base 14. The horizontal base 14 has a downward-facing surface for resting the device on a window sill or similar horizontal surface 16 adjacent to a window to be shaded. The window treatment frame may also be constructed of a molded plastic or any other construction material known to one having ordinary skill in the art. The window treatment frame may be a monolithic unit and may be secured to the surrounding structure by any portion of the frame. For example, holes may be defined in the window treatment frame for receiving screws and/or nails to secure the window treatment frame to the surrounding structure.

The inner space defined by arch 12 and horizontal base 14 is filled with a first and second shade panel 20 and 22. It is also contemplated that the shade panel for filling the inner space defined by arch 12 and horizontal base 14 may be formed of a single panel. The shade panel is preferably formed in a pleated or honeycomb configuration. Alternatively, the shade panel may be formed of a plurality of louvers configured and dimensioned to occupy at least a majority of the space defined by arch 12 and horizontal base 14.

Figure 2:
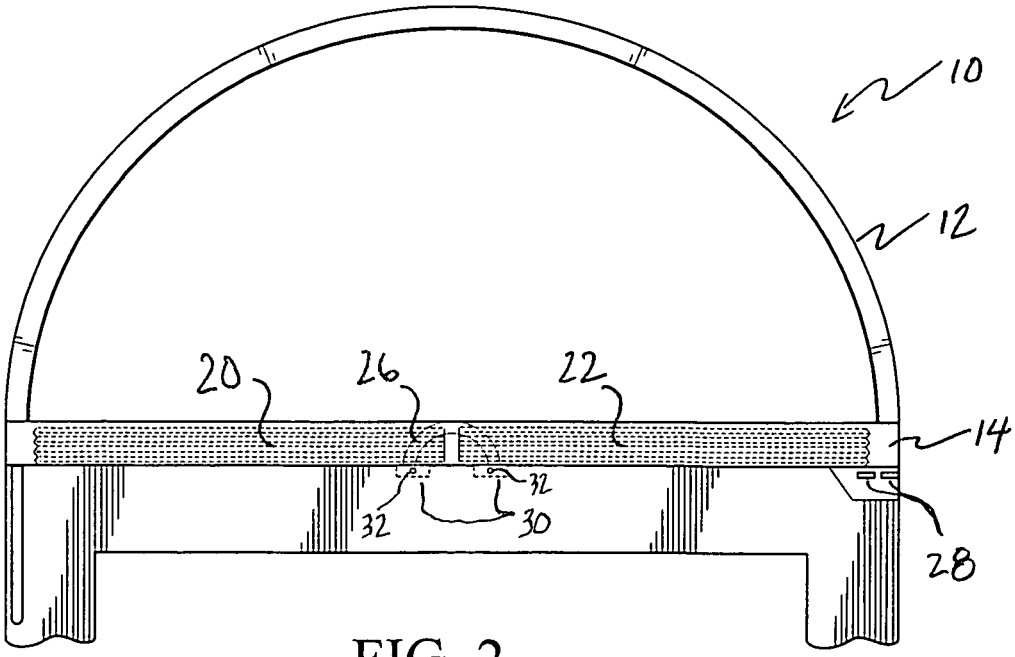
FIG. 2 is a front view illustrating a window treatment for an arch-shaped window in an open position, in accordance with an embodiment of the present invention.

Referring now to FIG. 2, the first and second shade panels are illustrated in the fully retracted position. In other words, the window treatment for an arch-shaped window is illustrated in an open position, in accordance with an embodiment of the present invention. The configuration of the shade panels according to the present invention advantageously provides for a low profile of approximately one inch, thereby maximizing the amount of light which is capable of entering the room through the window. A pivot bar 26 is positioned in the middle of horizontal base 14 and is configured in a U-shape. Pivot bar 26 permits first and second shade panels 20 and 22 to move between the open position illustrated in FIG. 2 to the closed position illustrated in FIG. 1. Pivot bar 26 may be secured to horizontal base 14 by means of locking nuts 30 secured to a lower threaded portion of pivot bar 26. Preferably, pivot bar 26 is removably secured in place by means of a pair of set screws and 32. Alternatively, pivot bar 26 may be welded in place or secured by any other means known to one having ordinary skill in the art.

Locking clips 28 are positioned and configured to provide a means for securing a chain which is used for opening and closing first and second shade panels 20 and 22, as will be discussed below. The first and second shade panels 20 and 22 are configured to be easily removed for cleaning and/or replacement. A plurality of shade clips and base clips are provided to maintain the first and second shade panels 20 and 22 within a predetermined position in window treatment 10, as will be discussed in further detail below. To remove first and second shade panels 20 and 22, begin by moving the shade panels 20 and 22 into their fully open position as illustrated in FIG. 2. Next, loosen the set screws 32 and remove pivot bar 26. Once pivot bar 26 is removed, loosen the base clips that hold the shades to the horizontal base 14 and remove the shade 20 and/or 22 from the clip.

Figure 3:
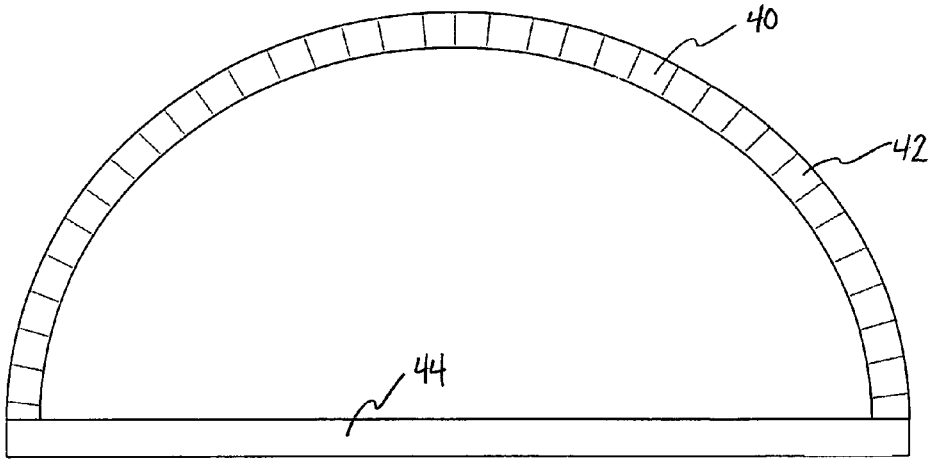
FIG. 3 is a front view illustrating a valence associated with the window treatment for an arch-shaped window, in accordance with an embodiment of the present invention.

Referring now to FIG. 3, a valence 40 associated with the window treatment 10 for an arch-shaped window, in accordance with an embodiment of the present invention is illustrated. The valence 40 serves the function of hiding portions of the window treatment which detract from the aesthetic features thereof. The valance 40 comprises an arch-shaped portion 42 and a horizontal portion 44. The valance 40 may be formed of the same material and texture as is used for the first and second shade panels 20 and 22.

Figure 4:
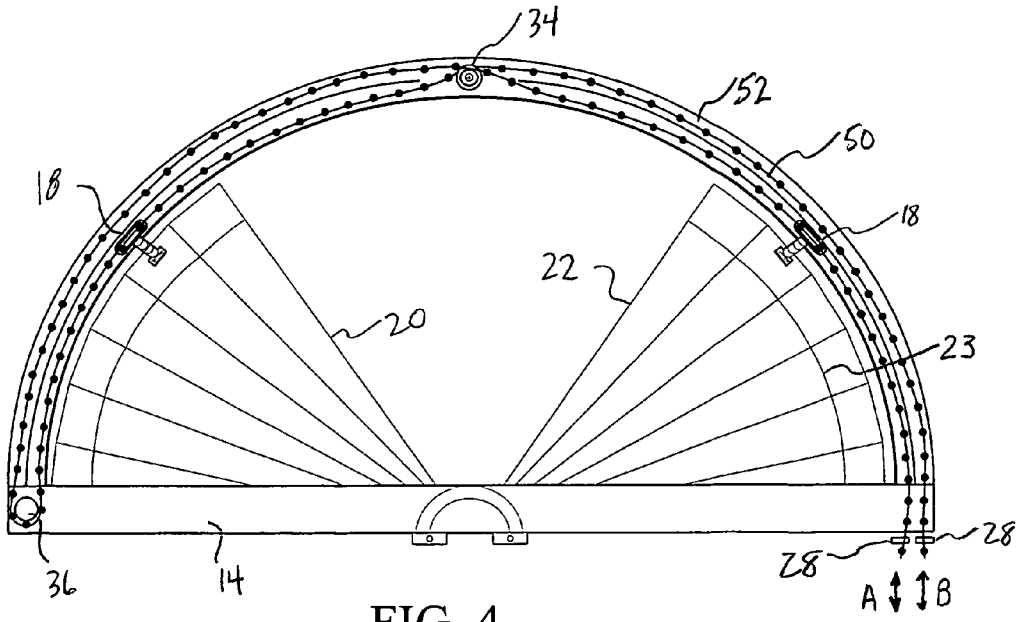
FIG. 4 is a cross-sectional front view illustrating a chain route for a window treatment for an arch-shaped window, in accordance with an embodiment of the present invention.

FIG. 4 is a front view illustrating a route for a chain 50. Very often, the windows that are arch-shaped are positioned above existing windows and/or doors. Therefore, the length of chain 50 may be varied to permit easy access to a user. Chain 50 may be moved in the directions indicated by arrows A and B to cause movement of first and second shade panels 20 and 22 between an open and a closed position. Dollys 18 are configured and dimensioned for moving first and second shade panels 20 and 22 between an open and a closed position. A string 23 is connected to shade panels 22 and 23 to assist in maintaining shade panels 22 and 23 in a uniform configuration. A first end of dolly 18 is secured to chain 50 and a second end of dolly 18 is secured to a portion of the shade panel. Accordingly, as chain 50 is moved in a direction of either of arrows A and B, that motion will be translated through a dolly 18 to the shade panels 20 and 22. Importantly, due to the configuration of the route of the chain 50, each of first and second shade panels 20 and 22 will move in the same direction. Locking clips 28 are provided to lock chain 50 in a desired position to prevent further movement of the first and second shade panels 20 and 22.

Rollers 34 and 36 are provided to guide chain 50 within a chain channel 52. Roller 34 is centrally located at the top of arch-shaped portion 12 of the frame and roller 36 is located at the end of the chain 50 at an end of base 14 opposite to the end of base 14 wherein the chain 50 leaves and enters.

Figure 5:
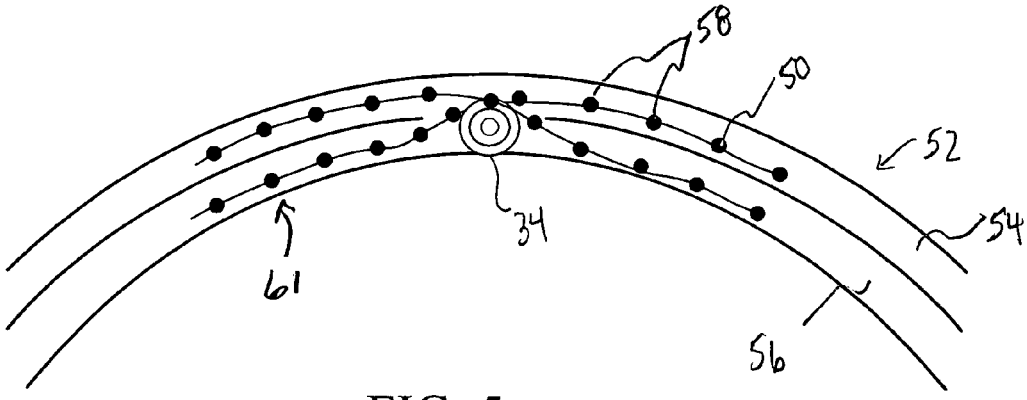
FIG. 5 is a cross-sectional front view illustrating a portion of a chain route for a window treatment for an arch-shaped window, in accordance with an embodiment of the present invention.
Figure 6:
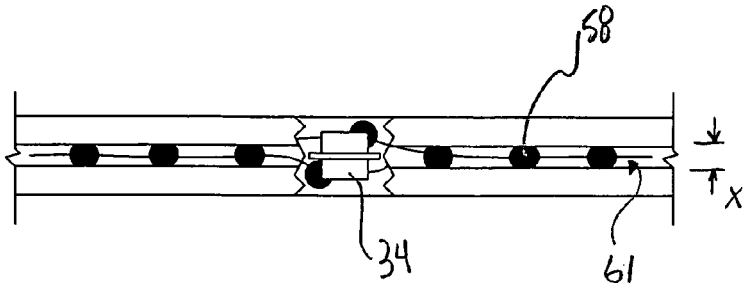
FIG. 6 is a cross-sectional view from the bottom looking up illustrating a portion of a chain route for a window treatment for an arch-shaped window, in accordance with an embodiment of the present invention.

At least a portion of the route of chain 50 is shown more clearly in FIG. 5. First, as shown in FIG. 5, chain channel 50 is divided into two separate channels—a chain return channel 54 and a dolly channel 56. Chain 50 travels in the chain return channel 54 until it hits roller 34. At this point, as shown in FIGS. 5 and 6, chain 50 crosses over and begins to travel within dolly channel 56. In accordance with an embodiment of the present invention, chain 50 is prevented from falling out of the longitudinal slot 61 defined in the lower portion of dolly channel due to the size of the beads 58 on chain 50.

As shown more clearly in FIG. 6, the diameter of each of the beads 58 along the length of chain 50 is greater than the width of the slot 61, thus allowing the dolly 18 to travel along the slot 61 while chain 50 is maintained within the dolly channel 56 as it is pulled through the arched frame. The width x of slot 61 is maintained relatively narrow to allow shade clip arm 62 (FIG. 7) to be guided along the channel.

Figure 7:
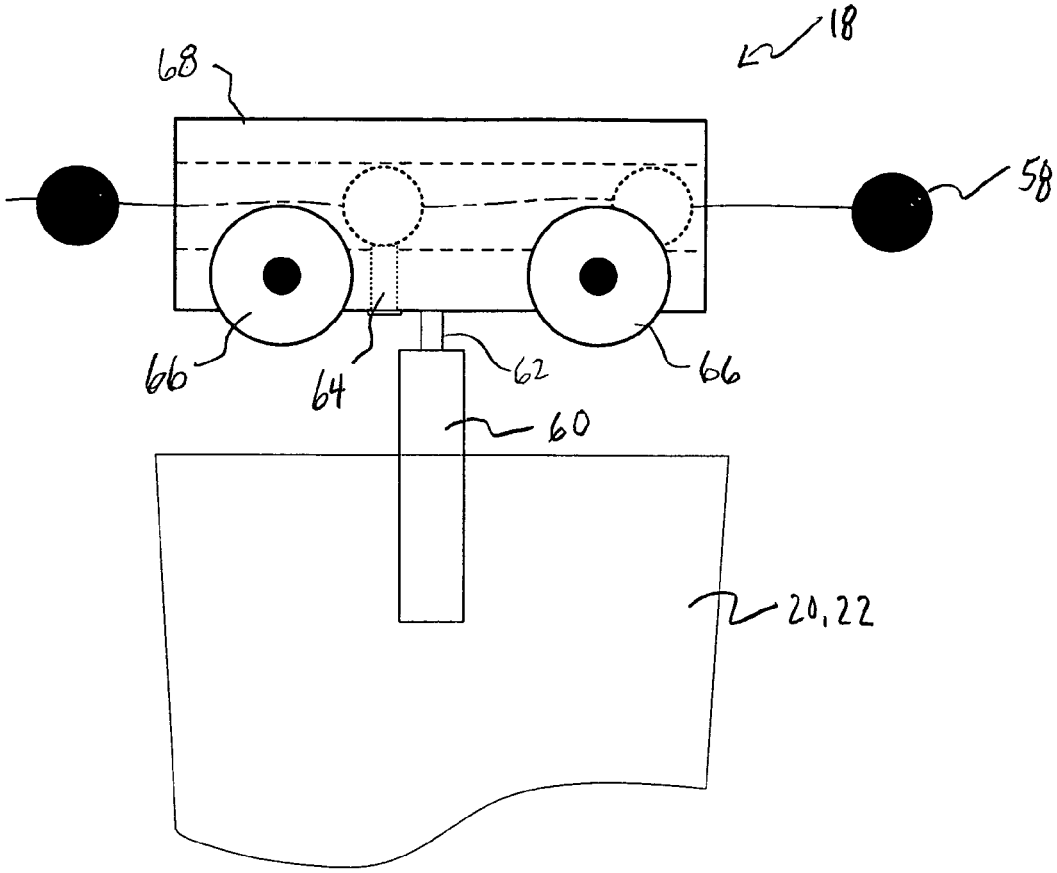
FIG. 7 is a side view of a dolly for use with a window treatment for an arch-shaped window, in accordance with an embodiment of the present invention.
Figure 8:
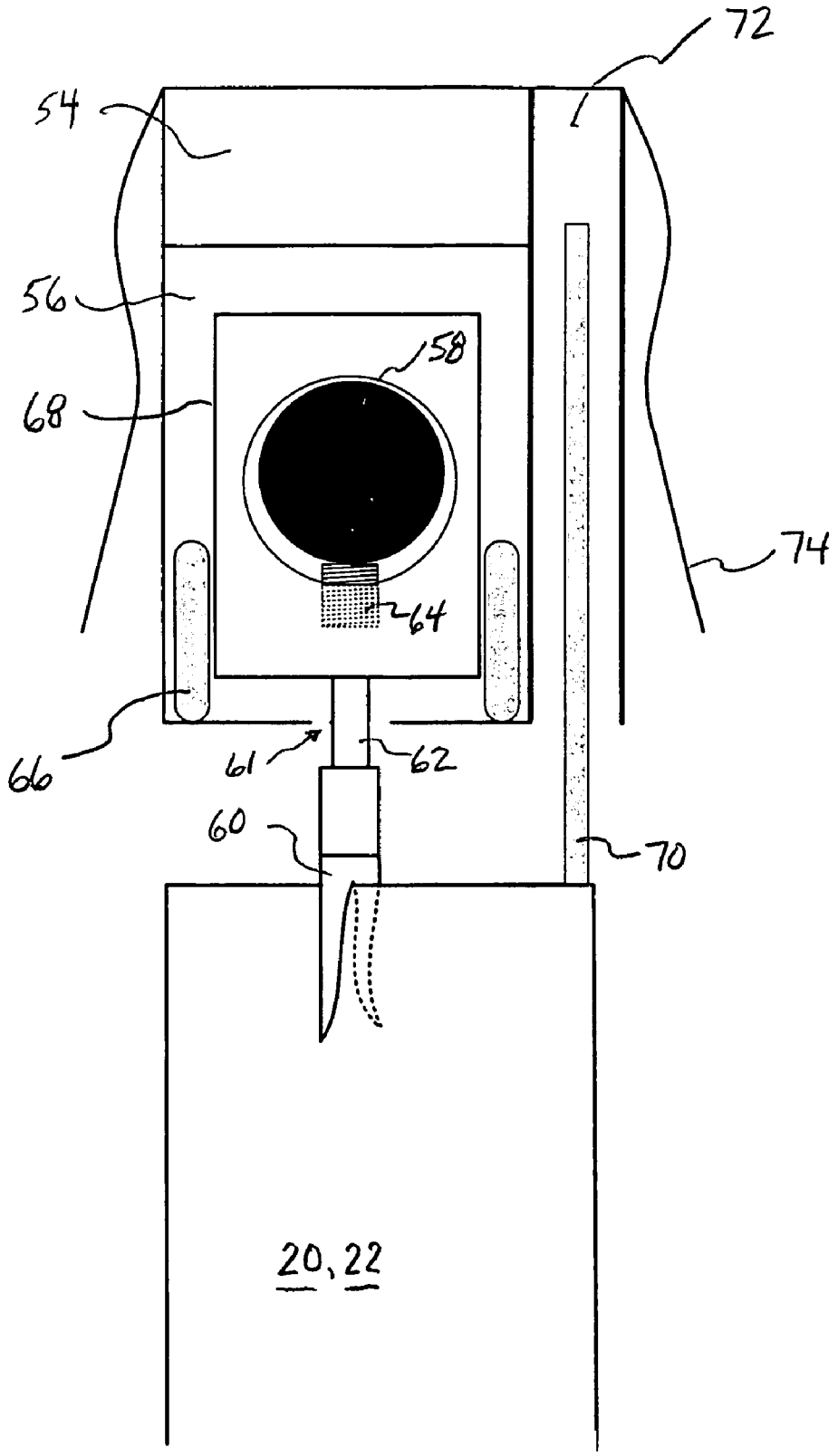
FIG. 8 is a cross-sectional end view illustrating a track for use with a window treatment for an arch shaped window, in accordance with an embodiment of the present invention.

FIG. 7 is a cross-sectional side view of dolly 18 for use with a window treatment 10 for an arch-shaped window, in accordance with an embodiment of the present invention. FIG. 8 is a cross-sectional end view of the dolly 18 illustrated in FIG. 7. Thus, with reference to FIGS. 7 and 8, dolly 18 includes a shade clip 60, a shade clip arm 62, a set screw 64 and a dolly housing 68. The shade clip 60 extends from a lower surface of dolly housing 68 via shade clip arm 62. The shade clip 60 is configured to attach to the shade 20, 22. Preferably, shade clip 60 is connected to the top one-fifth portion of shade panels 20, 22. The shade clip 60 location assists in preventing light from shining through a gap between the first and second shade panels 20, 22 when they are in a closed position. Set screw 64 is configured to secure housing 68 to the chain 50 by tightening the set screw 64 against a portion of the chain 50, such as, for example, a chain bead 58 as illustrated in FIG. 7. Wheels 66 are provided to assist movement of housing 68 along the dolly channel 54.

As best illustrated in FIG. 8, the dolly 18 travels in dolly channel 56 which is located adjacent to chain return channel 54. A guide pin chamber 72 is positioned adjacent to each of dolly channel 56 and chain return channel 54. Guide pin chamber 72 houses a plurality of guide pins 70. Guide pins 70 are positioned to support the shade panel 20, 22 from being blown out of the frame by a wind coming in through the window. The guide pins 70 are preferably attached to every third pleat of shade panel 20, 22 and move within guide pin chamber 72. Also shown in FIG. 8 is a clip 74 for attaching the valence (not shown) to the window treatment.

Figure 9:
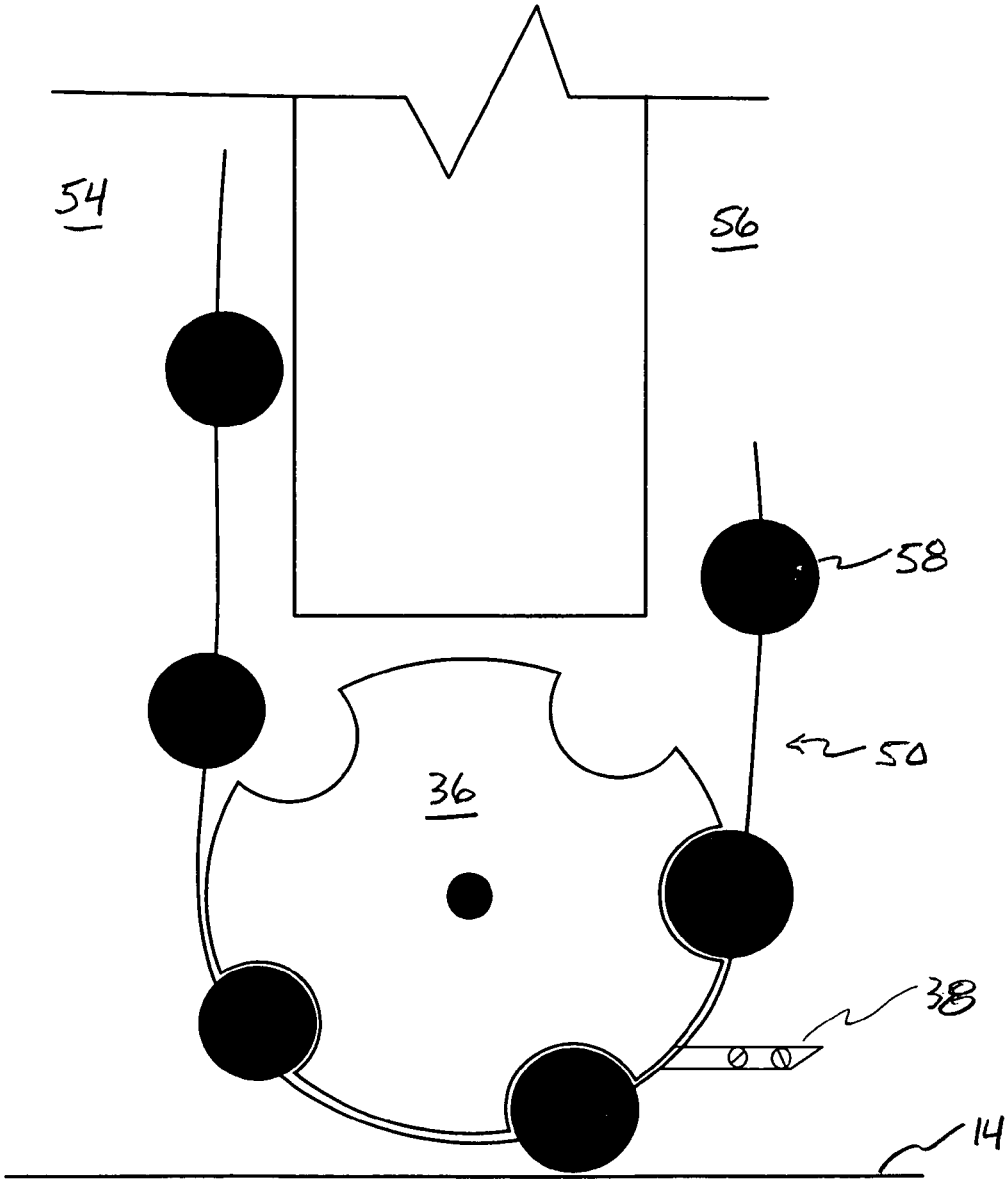
FIG. 9 is a side view illustrating a roller for use with a window treatment for an arch-shaped window in accordance with an embodiment of the present invention.

Referring now to FIG. 9, a side view of roller 36 is illustrated. As illustrated, a bracket 38 is secured to base 14. Roller 36 is rotationally attached to a portion of the bracket 38 to transfer the chain 50 from one of chambers 54 and 56 to the other of chambers 54 and 56. Roller 36 defines a plurality of indentations which are configured and positioned to engage beads 58 on chain 50. Roller 36 may also be connected to a motor for automatic operation of the window treatment.

Figure 10:
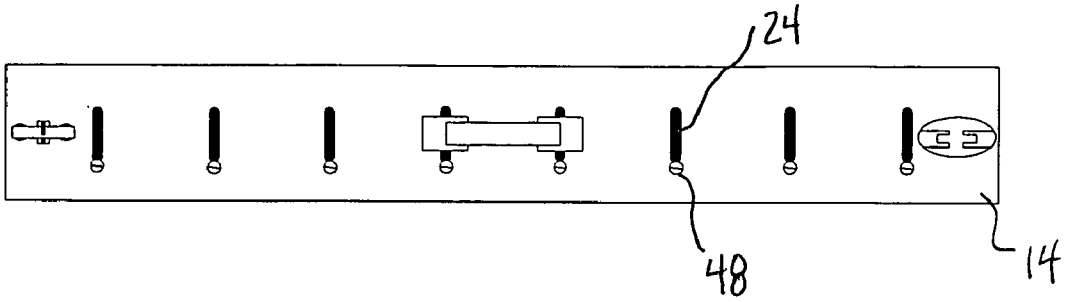
FIG. 10 is a top view of a base in accordance with an embodiment of the present invention.
Figure 11:
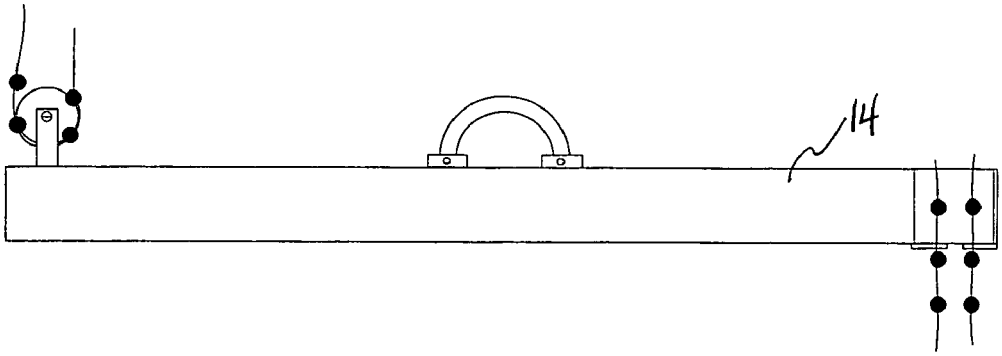
FIG. 11 is a side view of the base illustrated in FIG. 10 in accordance with an embodiment of the present invention.

FIGS. 10 and 11 are top and side views of a base 14 in accordance with an embodiment of the present invention. As shown in FIG. 10, a plurality of base clips 24 are positioned on base 14 for providing support to shade panels 20, 22. Set screws 48 are provided for each of the base clips 24. Set screws 48 may be loosened or removed to facilitate removal of the shade panels 20, 22 from the frame.

Figure 12:
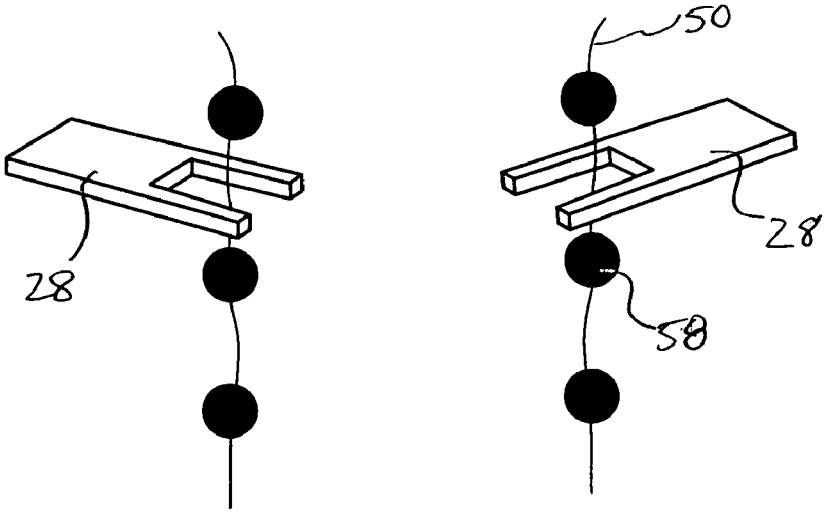
FIG. 12 is a prospective view illustrating chain locks for use with an embodiment of the present invention.

FIG. 12 is a prospective view illustrating chain locks 28 for use with an embodiment of the present invention. Chain locks 28 are designed to engage the chain 50 between two chain beads 58 to secure the chain from moving from a desired position.

Although the present invention has been described in accordance with the embodiments shown, one of ordinary skill in the art will readily recognize that there could be variations to the embodiment and these variations would be within the spirit and scope of the present invention. Accordingly, many modifications may be made by one of ordinary skill in the art without departing from the spirit and scope of the invention.

What is claimed is:

1. A window treatment for an arch-shaped window comprising:

a frame having an arch portion and a horizontal portion;

at least one shade panel pivotally connected to a central portion of the horizontal portion of the frame;

at least one channel formed on an inner surface of the arch portion, wherein the at least one channel forms a longitudinal slot on an inner surface of the arch portion of the frame adjacent the shade;

a chain at least partially housed within the at least one channel and moveable therein for effectuating arcuate movement of the at least one shade panel between an open and a closed position, wherein the chain is configured and dimensioned to move within the at least one channel without falling out of the longitudinal slot and further wherein the chain is positioned in the arch portion of the frame and not in the horizontal portion of the frame; and a separate guide track formed on the arch portion adjacent the at least one channel, wherein the separate guide track comprises a second longitudinal slot on the inner surface of the arch portion of the frame adjacent the shade, wherein the separate guide track holds at least one guide pin connected to the at least one shade panel, wherein said at least one guide pin is movable in the separate guide track.

2. The window treatment for an arch-shaped window as recited in claim 1 wherein said at least one shade panel comprises a first and a second shade panel.

3. The window treatment for an arch-shaped window as recited in claim 1 wherein said at least one shade panel is formed in a pleated configuration.

4. The window treatment for an arch-shaped window as recited in claim 1 wherein said at least one shade panel is formed in a honeycomb configuration.

5. The window treatment for an arch-shaped window as recited in claim 1 wherein said at least one shade panel is formed of a plurality of louvers configured and dimensioned to occupy at least a majority of the space defined by the arch portion and the horizontal portion.

6. The window treatment for an arch-shaped window as recited in claim 1 further comprising a pivot bar removably secured to the central portion of the horizontal portion.

7. The window treatment for an arch-shaped window as recited in claim 1 further comprising means for securing the chain in a fixed position.

8. The window treatment for an arch-shaped window as recited in claim 1 further comprising a valence mounted on the arch portion and the horizontal portion.

9. The window treatment for an arch-shaped window as recited in claim 1 further comprising at least one dolly connected to the at least one shade panel and configured for moving the at least one shade panel between an open and a closed position.

10. The window treatment for an arch-shaped window as recited in claim 9 wherein a first end of the dolly is secured to the chain and a second end of the dolly is secured to the at least one shade panel.

11. A window treatment for an arch-shaped window comprising:

a frame having an arch portion and a horizontal portion;

at least one shade panel pivotally connected to a central portion of the horizontal portion of the frame;

at least one channel formed on an inner surface of the arch portion, wherein the at least one channel forms a longitudinal slot on an inner surface of the arch portion of the frame adjacent the shade;

means for effectuating arcuate movement of the at least one shade panel between an open and a closed position, wherein the means is configured and dimensioned to move within the at least one channel without falling out of the longitudinal slot and further wherein the means for effectuating arcuate movement of the at least one shade panel is positioned in the arch portion of the frame and not in the horizontal portion of the frame; and a separate guide track formed on the arch portion adjacent the at least one channel, wherein the separate guide track comprises a second longitudinal slot on the inner surface of the arch portion of the frame adjacent the shade, wherein the separate guide track holds at least one guide pin connected to the at least one shade panel, wherein said at least one guide pin is movable in the separate guide track.

12. The window treatment for an arch-shaped window as recited in claim 11 wherein said at least one shade panel comprises a first and a second shade panel.

13. The window treatment for an arch-shaped window as recited in claim 11 wherein said at least one shade panel is formed in a pleated configuration.

14. The window treatment for an arch-shaped window as recited in claim 11 wherein said at least one shade panel is formed in a honeycomb configuration.

15. The window treatment for an arch-shaped window as recited in claim 11 wherein said at least one shade panel is formed of a plurality of louvers configured and dimensioned to occupy at least a majority of the space defined by the arch portion and the horizontal portion.

16. The window treatment for an arch-shaped window as recited in claim 11 further comprising a pivot bar removably secured to the central portion of the horizontal portion.

17. The window treatment for an arch-shaped window as recited in claim 16 wherein the pivot bar is configured in a U-shape.

18. The window treatment for an arch-shaped window as recited in claim 11 wherein the means for effectuating arcuate movement of the at least one shade panel between an open and a closed position is a chain and said chain is configured to move in a figure eight configuration.

19. The window treatment for an arch-shaped window as recited in claim 11 further comprising a valence mounted on the arch portion and the horizontal portion.

* * * * *